US005357714A

United States Patent [19]

Landhuis

[11] Patent Number: 5,357,714

[45] Date of Patent: Oct. 25, 1994

[54] APPARATUS FOR SHAPING THE ENDS OF TUBULAR WORKPIECES WITH RECESSES OF DIFFERENT DIAMETERS

[75] Inventor: Jan J. Landhuis, Vriezenveen, Netherlands

[73] Assignee: Almi Machinefabriek BV, Vriezenveen, Netherlands

[21] Appl. No.: 71,562

[22] Filed: Jun. 3, 1993

[30] Foreign Application Priority Data

Apr. 2, 1993 [DE] Fed. Rep. of Germany ..... 4310887

[51] Int. Cl.[5] ..... B24B 21/12; B24B 21/20

[52] U.S. Cl. ..... 451/311; 451/303

[58] Field of Search ..... 51/135 R, 148, 143, 51/141, 137, 170 EB, 290, 357

[56] References Cited

U.S. PATENT DOCUMENTS

| | | | |
|---|---|---|---|
| 1,841,411 | 1/1932 | Kux | 51/143 |
| 2,802,310 | 8/1957 | Chaplik | 51/135 R |
| 3,153,306 | 10/1964 | Robischong | 51/135 R |

FOREIGN PATENT DOCUMENTS

| | | | |
|---|---|---|---|
| 0647853 | 12/1950 | United Kingdom | 51/135 R |
| 0872366 | 7/1961 | United Kingdom | 51/135 R |

*Primary Examiner*—Robert A. Rose
*Attorney, Agent, or Firm*—Darby & Darby

[57] ABSTRACT

The invention relates to an apparatus for grinding recesses into the ends of tubular workpieces with a revolving, driven grinding belt, the front pulley of which apparatus has a diameter that corresponds to the diameter of the desired recess in a tube end, which pulley can easily be exchanged. Moreover, the pipe to be ground is disposed on a support assembly constructed with a clamping device, which can in turn be rotated to permit the grinding of such tube ends at angles other than 90°.

9 Claims, 5 Drawing Sheets

APPARATUS FOR SHAPING THE ENDS OF TUBULAR WORKPIECES WITH RECESSES OF DIFFERENT DIAMETERS

The invention relates to a grinding apparatus for shaping or recessing the ends of tubular workpieces. e.g., pipes, substantially semi-circularly, so that they can be fitted and joined to annular openings in the sides of other such workpieces or pipes by soldering, welding or like means. More particularly, it relates to belt grinding equipment adapted to make such semi-circular recesses irrespective of the diameters required therefor or the angles at which the pipes are to be connected together.

As shown by DE-27 08 418 C3. equipment has long been known for working tubular metal pipes with the objective of achieving a carefully sized and shaped recess in the end of a pipe to allow it to fit the diameter of another pipe closely when the first pipe is connected to it. But this known, hand-operated equipment is capable of machining only three predetermined recess sizes (i.e., diameters) and, above all, can work only on a pipe that is positioned precisely perpendicular to the grinding means and, therefore, that can be used only in forming pipe joints wherein the pipes intersect, and their interiors communicate, at right angles, i.e., have the configuration of a "T", a cross, or the like.

For larger plants, in which pipes frequently need to be connected and in which an angle required to connect two pipes is not necessarily 90°, so that the joint to be formed has, for example, the configuration of an "X" or a "K", this known hand-operated apparatus is clearly not suitable.

It is, therefore, an object of the present invention to provide a motor-driven grinding apparatus for giving the ends of pipes recesses of any diameter and at any angle desired and that is inexpensive to construct and operates inexpensively.

In other words, pursuant to the invention, the apparatus proposed is comprised of a belt grinder on two pulleys and has a front pulley that is adapted to be exchanged easily and quickly, so that grinding surfaces of different diameters can be achieved at the front end of the grinding belt. Furthermore, this machine is equipped with a support assembly that makes it possible, on the one hand, to guide the workpiece pipe that is, or the end of which is, to be recessed or ground out toward the front pulley of the grinding belt or away from it (i.e., retractably) and, on the other, to position the pipe squarely or at an angle to the front part of the grinding belt. In addition, this support assembly also has a device for clamping the pipe. Preferably, this clamping device is mounted on a disk, which can be rotated about an axis that is perpendicular to the axis of the front pulley and perpendicular to an imaginary line connecting the front pulley and the rear pulley of the grinding belt.

Such a machine is furthermore constructed so that the front pulley can be replaced rapidly and easily by pulleys of different diameters and, with such replacement, the desired recessing can be achieved on the pipe that is to be ground out. At the same time, the inventive machine is constructed so that the distance between the front pulley and the rear pulley can be varied so that, by a simple slackening of the grinding belt, the front pulley can be removed and, in the same way, by a simple manual operation, the tension in the grinding belt can be restored when a pulley has been replaced.

An embodiment of the invention is described in the following by means of the drawings, in which FIG. 1 shows a view of the subject apparatus from the side;

Figure 1:
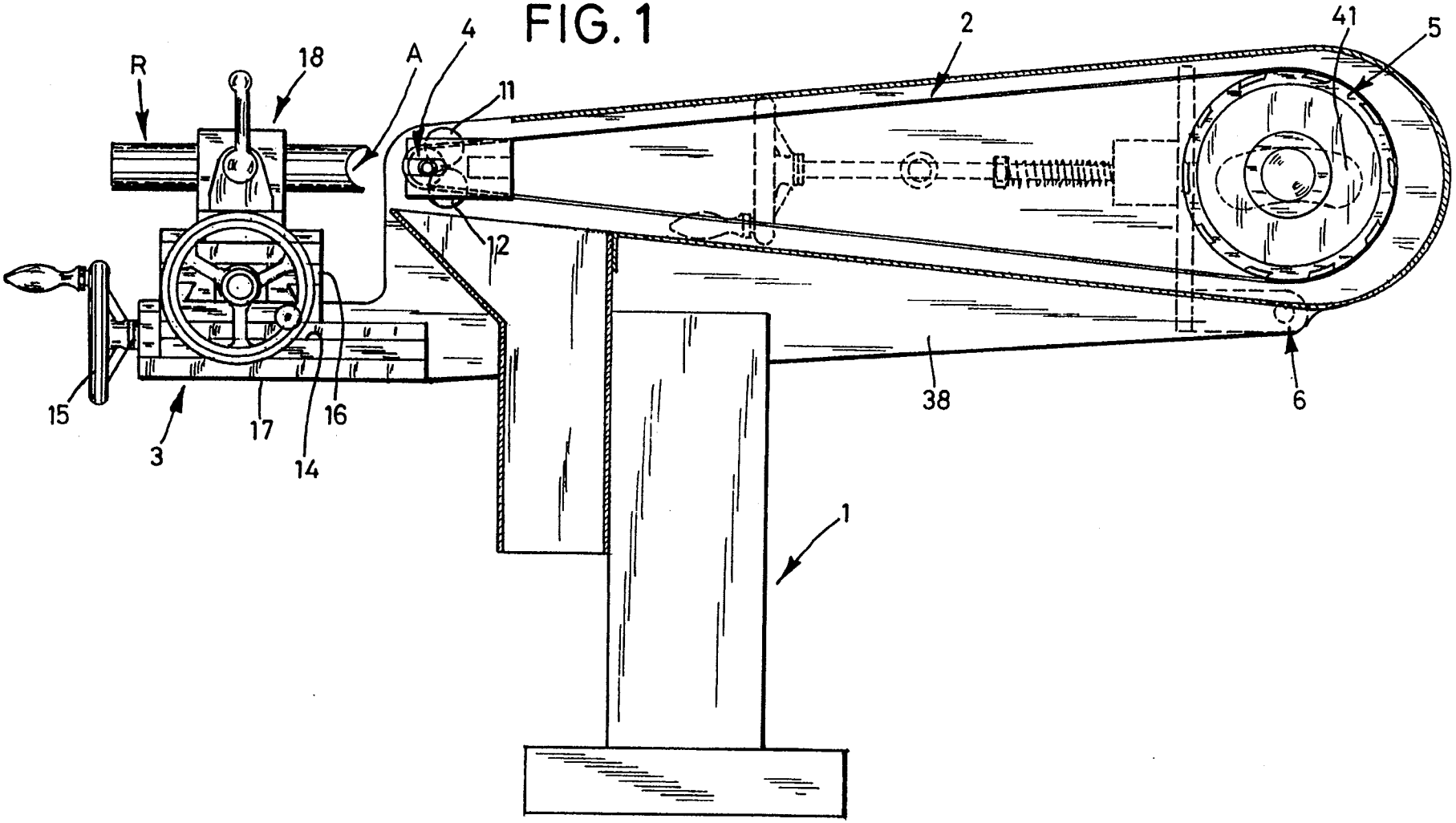
Figure 2:
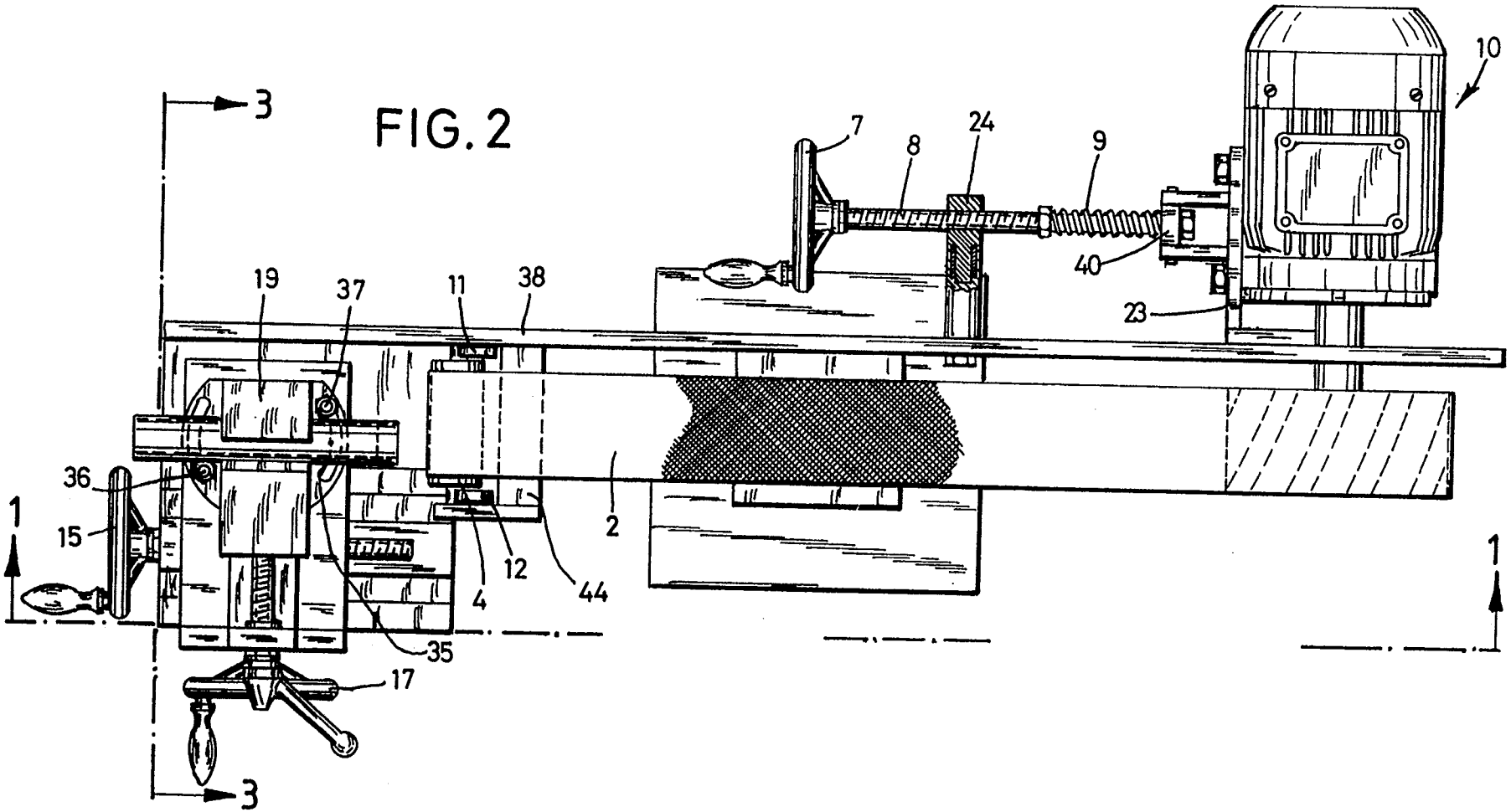
FIG. 2 shows a plan view of the subject apparatus.

In the drawings, in FIGS. 1 and 2, a vertical post 1 supports a grinding machine frame 38 having grinding belt 2 and a driving motor 10 mounted on the right side and a first support member 3 on the left side. As shown in FIG. 2; driving motor 10 is connected to a second support member 23 and thence to machine frame 38 by means of swivel bearing 6. Support 23 with motor 10 can be rotated about swivel bearing 6. This swiveling motion, on the one hand, is prevented and, on the other, made possible by a spindle 8, which carries a handwheel 7 at one end and is connected to support member 23 at the other by means of a swivel carriage 40. Spindle 8 is held by and guided through a spindle nut 24, which is supported by machine frame 38. A spring 9 is positioned between the swivel carriage 40 and region 24 of spindle 8, which is provided with a thread. Spring 9 serves to adjust, or to compensate for, tension in grinding belt 2.

Grinding belt 2 passes over a rear pulley 5, which is connected with the motor 10, and a front pulley 4. FIG. 1 clearly shows that the connecting shaft between the motor 10 and the rear pulley 5 lies in an elongated-hole guide 41, so that it is possible to adjust or change the distance between the front pulley 4 and the rear pulley 5.

In FIG. 1, at the left end of machine frame 38, a first support member or sub-assembly 3 is shown and it is comprised of three separate elements, namely 1. a longitudinal slide 14, which can be moved by means of a handwheel 15 toward and away from (left to right and vice versa in FIGS. 1 and 2 relative to the front pulley 4;

2. a transverse slide 16, which can be moved by means of a handwheel 17 back and forth (up and down and vice versa in FIG. 2) parallel to the axis of the front pulley 4;

3. a clamping device 18 including a stationary clamping jaw 19 and movable clamping jaw 20 wherein the movable clamping jaw 20 can be opened and closed by means of a shaft 22, which has a handle 21.

As shown in FIG. 2, with workpiece support member 3, it is possible to fix pipe R of any diameter in the clamping device 18, to move the pipes out of parallel to axis of the front pulley 4 and, optionally, to move pipe R simultaneously toward (or away from) the front pulley 4.

Figure 3:
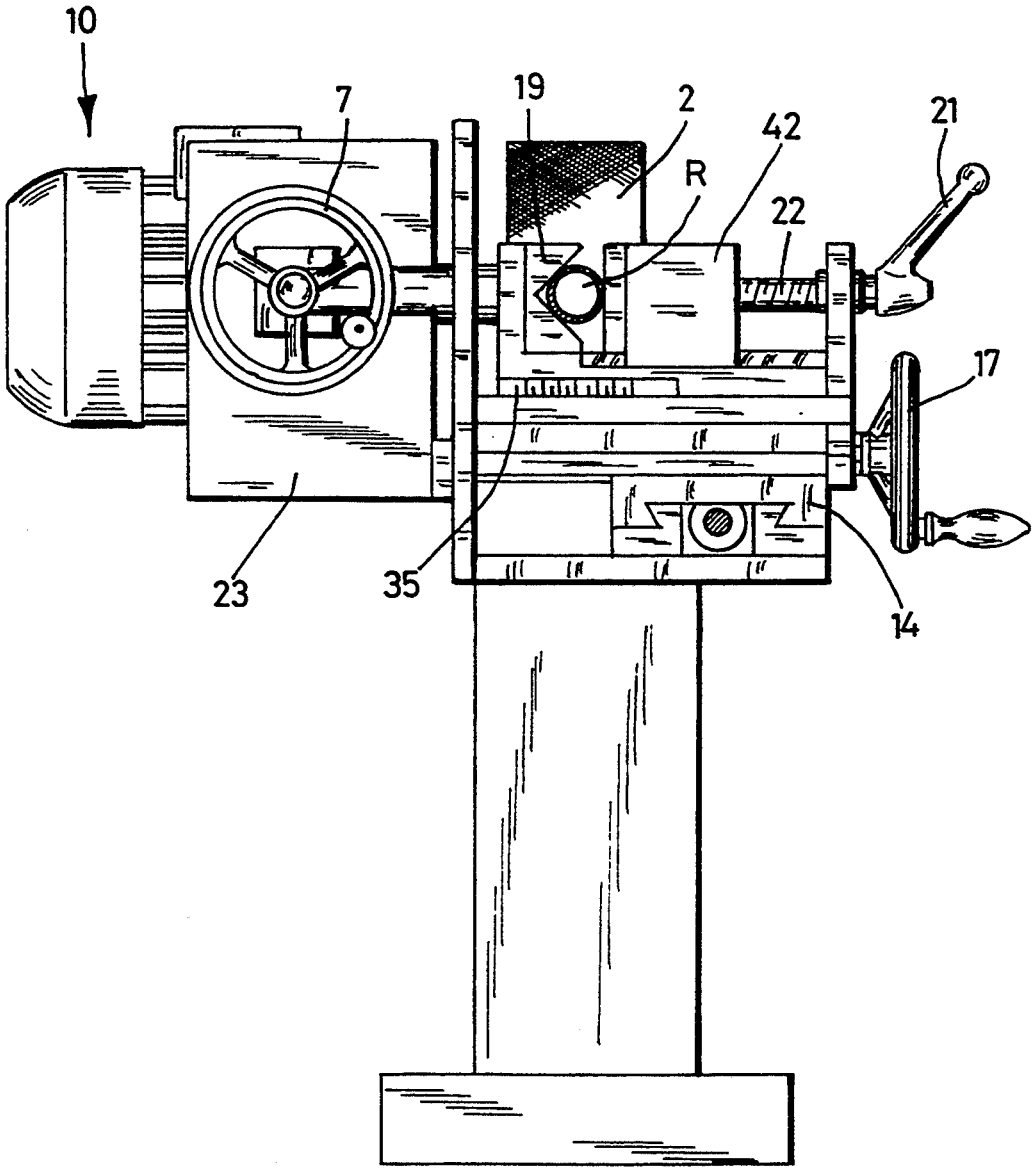
FIG. 3 shows a view of the section along the line 3—3 of FIG. 2.
Figure 4:
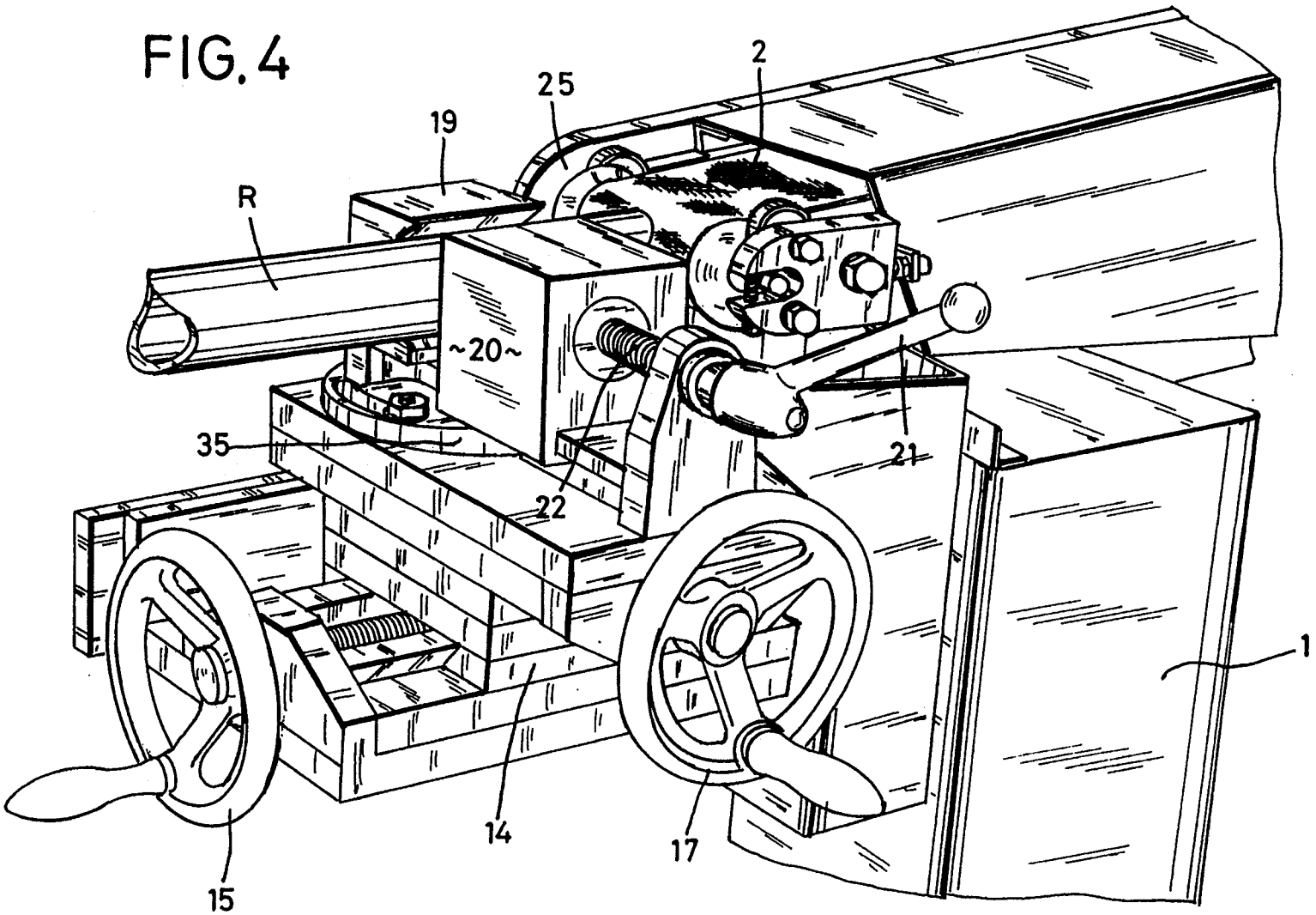
FIG. 4 shows larger scale isometric view of a support sub-assembly of the subject apparatus holding a clamped pipe; and, FIG. 5 shows a larger scale isometric view of the two sidewalls of the front pulley housing of the subject apparatus.

In order to be able to carry out the recessing of pipe R at different angles, the clamping device 18 is connected to transverse slide 16 by means of a disk 35, which can be rotated about an axis that is nonintersecting with and at a right angle to the axis of the front pulley 4 and at a right angle to the imaginary line that connects the front pulley 4 and the rear pulley 5. As shown in FIG. 3, the edge of the disk 35 can be provided with angle markings, so that it is easily possible to check the angle at which pipe R is set.

Figure 5:
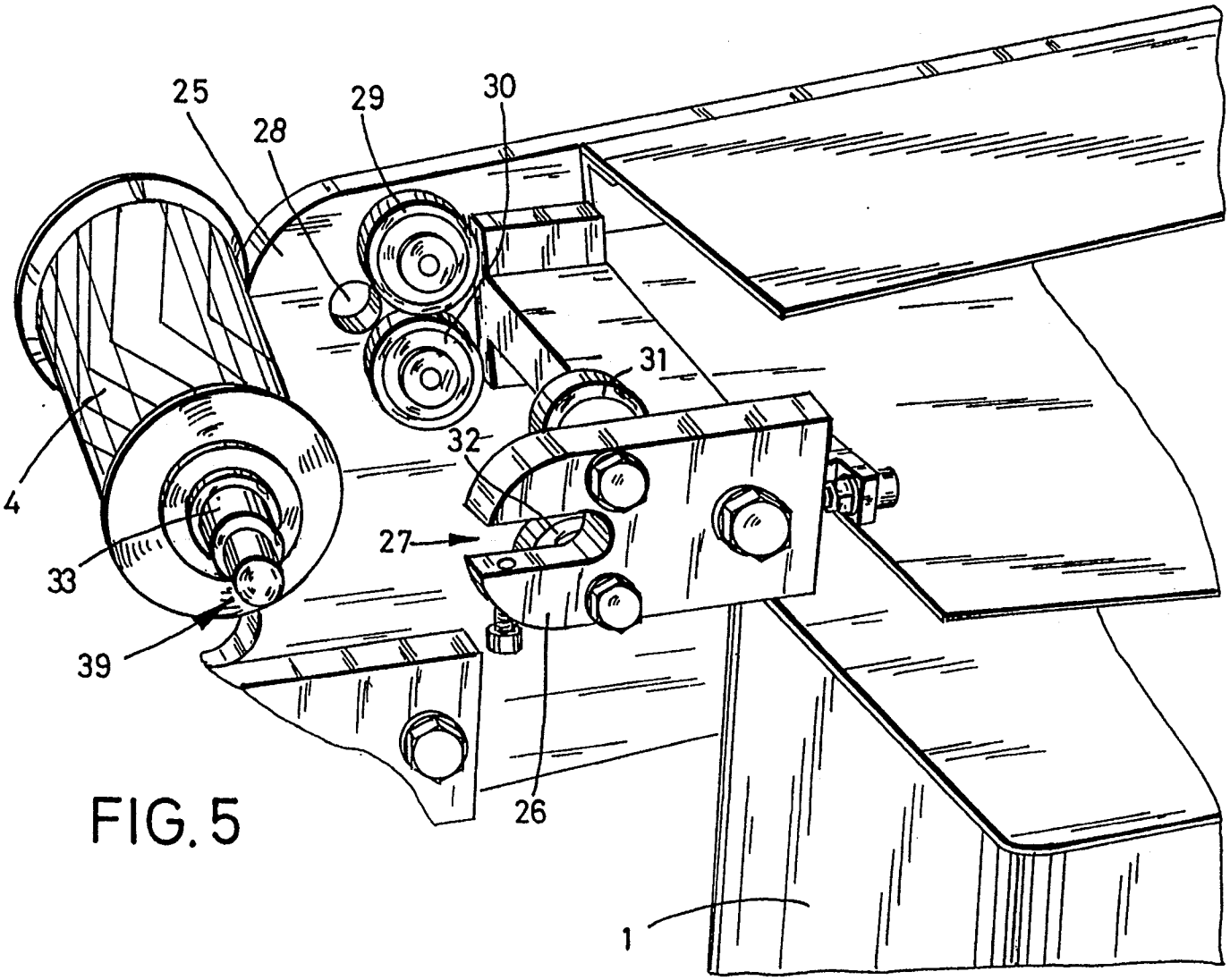

To enable production of different end recesses A for a pipe R, it is desirable to be able to change the front pulley 4 easily. This is achieved by the arrangement shown on a larger scale in FIG. 5. The two housing sidewalls 25 and 26 are shown in FIG. 5. Sidewall 25 of the housing may be an extension of machine frame 38, which is shown in FIG. 2. A borehole 28 is provided in sidewall 25 of housing, while the front end of the housing wall 26 is constructed as a fork, so that the free space 27 between the prongs of the fork is created. The front pulley 4 can be seen in FIG. 5: it has a shaft 39. which has ball bearing races 33 on both sides of pulley 4. At the sidewalls 25 and 26 of the housing, ball bearings or wheels 29 and 30 or 31 and 32 are disposed, so that the ball races 33 come to lie against the wheels 29 and 30 or 31 and 32 when the shaft 39 of the front pulley 4 is inserted in the borehole 28 and the opposite end of the shaft is pushed into the fork 27. The shaft 39 of the front pulley 4 is then thus supported. Subsequently, when a change has been made in pulley 4, it is possible to push the slackened grinding belt 2 over the replacement front pulley 4 and, by shifting the motor 10 in second support member 23 and the rear pulley 5 by operating the handwheel 7 and the spindle 8, to pull the grinding belt 2 tight once again, so that work can be carried out once more.

In order to make it possible to remove the grinding belt easily, the front sidewall 26 of the housing is constructed as an elbow 44, which is supported by the machine frame 38. See FIG. 2.

It can be seen from the description of the invention that pipes R of any diameter can be given end substantially semi-circular recesses to any angle desired with the new apparatus. The front pulley 4 can be exchanged very easily for other front pulleys having desired diameters.

What is claimed is:

1. An apparatus for recessing the ends of tubular workpieces with different diameters, comprising:

(a) a grinding belt machine frame;

(b) a revolving driven grinding belt trained around front and rear pulleys, the front pulley having a diameter which corresponds to a diameter of a desired recess and being rotatable about a first axis;

(c) a first support member connected to the grinding belt machine frame and having a longitudinal slide, a transverse slide and a clamping device that holds and carries the workpiece on the longitudinal slide for retractable movement against the grinding belt at the front pulley; and (d) said clamping device being mounted for swivel movement about an axis that is nonintersecting and aligned perpendicularly with said first axis, said clamping device including a stationary counteracting jaw and a movable clamping jaw that is movable towards and away from said stationary counteracting jaw, the longitudinal slide having an axis of displacement, the transverse slide having an axis of displacement and being movably disposed on the longitudinal slide, said movable clamping jaw being mounted on the transverse slide, the axis about which the clamping device swivels extending transverse to the axis of displacement of the longitudinal slide and transverse to the axis of displacement of the transverse slide.

2. The apparatus of claim 1, wherein the clamping device is mounted in a rotatable disk; and means for locking said rotatable disk in position.

3. The apparatus of claim 1, wherein the rear grinding belt pulley serves as a grinding belt drive means, is connected by a second support member to a motor, and means for swiveling said motor and second support member about a drag bearing having an axis to adjust the distance between the axis of the rear pulley and the axis of the front pulley.

4. The apparatus of claim 3, wherein a hand-operated spindle having an axis controls the swiveling motion of the motor and the second support member about the drag bearing.

5. The apparatus of claim 4, wherein the spindle is guided in a spindle nut that is supported by the grinding belt machine frame and is connected by means of a coiled spring to the second support member.

6. The apparatus of claim 5, wherein the spindle is connected to the second support member about an axis, that is aligned transversely to the spindle axis, but parallel to the axis of the drag bearing (6).

7. The apparatus of claim 1, wherein the front pulley includes a shaft, the axis about which the front pulley is rotatable extending through said shaft, a support for the front grinding belt pulley being comprised of (a) two housing sidewalls that are mounted on the grinding belt machine frame, one of which being constructed as a fork and the other of which having a borehole, the fork having tines between which is defined a space;

(b) bearing wheels, two of which being mounted on the borehole sidewall and two of which being mounted on the fork sidewall for rotatable engagement with ball bearing races positioned on the shaft of the front pulley, the shaft having an end inserted in the borehole and having an opposite end received in the space defined between tines of the fork.

8. The apparatus of claim 1, further comprising disk means for swivelling said clamping device about the axis that is aligned perpendicularly to said first axis, said clamping device being mounted to the transverse slide via said disk means.

9. The apparatus of claim 1, wherein the axis about which the clamping device swivels extends perpendicularly to the axis of displacement of the transverse slide and extends perpendicularly to the axis of displacement of the longitudinal slide.

* * * * *